US008777068B2

(12) United States Patent
Diamond et al.

(10) Patent No.: US 8,777,068 B2
(45) Date of Patent: Jul. 15, 2014

(54) NESTABLE HANGER WITH HOOK INSERT

(76) Inventors: Aaron Diamond, Hollis Hills, NY (US); Robert Doherty, Northport, NY (US)

( * ) Notice: Subject to any disclaimer, the term of this patent is extended or adjusted under 35 U.S.C. 154(b) by 13 days.

(21) Appl. No.: 13/424,513

(22) Filed: Mar. 20, 2012

(65) Prior Publication Data

US 2012/0234876 A1 Sep. 20, 2012

Related U.S. Application Data

(63) Continuation-in-part of application No. 13/008,970, filed on Jan. 19, 2011, now abandoned, which is a continuation-in-part of application No. 12/182,351, filed on Jul. 30, 2008, now Pat. No. 7,938,300.

(51) Int. Cl.
*A41D 27/22* (2006.01)
*A41D 27/12* (2006.01)

(52) U.S. Cl.
USPC ..... 223/85

(58) Field of Classification Search
USPC ..... 223/85–96; 248/339; D6/315–328, 372; D8/367, 373
See application file for complete search history.

(56) References Cited

U.S. PATENT DOCUMENTS

| | | | | | |
|---|---|---|---|---|---|
| 182,265 | A * | 9/1876 | Barker | 248/339 |
| 1,580,839 | A * | 4/1926 | McKenna | 223/88 |
| 2,498,400 | A * | 2/1950 | Du Lude | 223/88 |
| 2,808,942 | A * | 10/1957 | Harrison et al. | 211/119.004 |
| 3,085,724 | A * | 4/1963 | Wilde | 223/85 |
| 3,191,770 | A * | 6/1965 | Zuckerman | 206/300 |
| 4,034,865 | A * | 7/1977 | Batts et al. | 211/118 |
| 4,653,678 | A * | 3/1987 | Blanchard et al. | 223/85 |
| 4,871,098 | A * | 10/1989 | Bredeweg et al. | 223/85 |
| 5,074,445 | A * | 12/1991 | Chen | 223/85 |
| 5,803,321 | A * | 9/1998 | Willinger et al. | 223/88 |
| 5,810,216 | A * | 9/1998 | Leopold | 223/85 |
| 6,070,772 | A * | 6/2000 | Bond | 223/85 |
| 6,105,834 | A * | 8/2000 | Cohen | 223/88 |
| 6,308,872 | B1 * | 10/2001 | Duerr et al. | 223/88 |
| 6,457,615 | B1 * | 10/2002 | Lam | 223/89 |
| 6,467,658 | B1 * | 10/2002 | Olk et al. | 223/88 |
| 6,758,379 | B1 * | 7/2004 | Elwell | 223/85 |
| D563,110 | S * | 3/2008 | Mangano | D6/328 |
| 7,404,502 | B2 * | 7/2008 | Ho et al. | 223/85 |
| 8,267,287 | B2 * | 9/2012 | Gouldson | 223/88 |
| 2007/0251961 | A1 * | 11/2007 | Fryer et al. | 223/85 |
| 2008/0283558 | A1 * | 11/2008 | Rude et al. | 223/94 |

* cited by examiner

*Primary Examiner* — Ismael Izaguirre
(74) *Attorney, Agent, or Firm* — Jeffey Sonnabend; SonnabendLaw

(57) ABSTRACT

A garment hanger is disclosed having a hook insert therein wherein the hook may be inserted into the body of its hanger to facilitate the nesting of one hanger with the other like hanger.

16 Claims, 20 Drawing Sheets

NESTABLE HANGER WITH HOOK INSERT

CROSS REFERENCE TO RELATED APPLICATIONS

This application is a continuation-in-part and claims the benefit of U.S. application Ser. No. 13/008,970, filed on Jan. 19, 2011 now abandoned, entitled, "Nestable Hangar With Articulating Integrated Hook", which is a continuation-in-part and claims the benefit of U.S. application Ser. No. 12/182,351, filed on Jul. 30, 2008 now U.S. Pat. No. 7,938,300, entitled Nestable Hangar With Integrated Cascade Hook, both of which are incorporated in their entirety herein by reference.

BACKGROUND OF THE INVENTION

1. Field of the Invention

The present invention generally relates to the field of clothing hangers and in particular to the field of nestable hangers having hanger supporting means for supporting additional hangers therefrom. Specifically, the present invention pertains to a clothing hanger that includes an articulating hook for attaching an additional hanger thereto. By having such functionality, a clothing hanger can both add additional hangers and be stored in a nested fashion thereby using a minimal amount of storage.

2. Description of the Related Art

Hangers having nestable configurations are disclosed in the prior art, as are hangers having hanger supporting means for supporting additional hangers therefrom.

One example of a hanger having hanger supporting means for supporting additional hangers therefrom may be found, for instance, in U.S. Pat. No. 4,653,678 to Blanchard et al., which discloses a "ganging hook" via which additional hangers may be supported. The "ganging hook" disclosed in Blanchard et al. extends downwardly from the hanger body. The "ganging hook" of Blanchard et al. does not provide any nesting functionality to the hanger.

Another example of a hanger having supporting means for supporting additional hangers therefrom is U.S. Pat. No. 4,871,098 to Bredeweg et al. The hanger disclosed in Bredeweg et al. discloses a "hook socket for ganging hangers". As with Blanchard et al., the "hook socket" of the hanger disclosed in Bredeweg et al. extends downwardly from hanger body and does not provide any nesting functionality.

U.S. Pat. No. 5,074,445 to Chen discloses a garment hanger with a "ganging hook" extending from the hanger body. The position of the "ganging hook" of Chen impedes nesting of hangers.

Similarly, U.S. Pat. No. 5,803,321 to Willinger et al. discloses a hanger having "ganging element" extending downwardly from the hanger body. As with the previously cited prior art, the "ganging element" of the hanger disclosed in Willinger et al. does not promote nesting of hangers. Like hangers may also be found in U.S. Pat. No. 6,070,772 to Bond; U.S. Pat. No. 6,105,834 to Cohen; U.S. Pat. No. 6,308,872 to Duerr et al.; and U.S. Pat. No. 6,467,658 to Oik et al.

None of the foregoing prior art discloses hangers with hanger supporting means for supporting additional hangers therefrom configured in such a manner so as to allow for nesting of hangers. It is therefore desirable to have a hanger which not only includes hanger supporting means for supporting additional hangers therefrom, but further readily provides for nesting of hangers. There is therefore a great need in the art for a hanger providing such characteristics.

Accordingly, there is now provided with this invention an improved clothing hanger that effectively overcomes the aforementioned difficulties and longstanding problems discussed above. These problems have been solved in a simple, convenient, and highly effective way by which to form a clothing hanger.

SUMMARY OF THE INVENTION

According to one aspect of the invention, a new and useful hanger having a hanger supporting means in the form of a cascade hook for supporting additional hangers therefrom, wherein the cascade hook facilitates the nesting of one hanger with another similar hanger is disclosed.

One embodiment of the present invention includes a garment hanger comprising a hanger frame comprising a hanger body, the hanger body having a front surface and a rear surface, a top and a bottom; a hook member extending from the top of the hanger body, the body having a hole formed therethrough, the hole having a front aperture formed in the front surface and a rear aperture formed in the rear surface; the body having a cascade hook member extending from the front surface and disposed in front of the front aperture. In these embodiments, the hole is adapted to receive through the rear aperture a cascade hook member from a first identical garment hanger and the cascade hook member is adapted to be inserted into a rear aperture of a hole in a second identical garment hanger.

In certain embodiments, the cascade hook member has an inclined portion having a first end disposed at the bottom of the hole and a second end disposed opposite from the first end, and a second portion extending upwardly from the second end of the inclined portion embodiments, the cascade hook member has an inclined portion having a first end disposed at the bottom of the hole and a second end disposed opposite from the first end, and a second portion extending upwardly from the second end of the inclined portion.

In any of the foregoing embodiments, the cascade hook member may comprise a rear surface substantially facing the front surface of the body; a front surface substantially facing away from the front surface of the body. A projection of the cascade hook member onto a plane containing the front surface of the body may be shaped substantially the same as the front aperture, and the projection may have an area less than the area of the front aperture. The rear aperture may have an area greater than the area of the front aperture. There may also be a concavity formed in the rear surface of the cascade hook member.

Furthermore, in any of the foregoing embodiments, the cascade hook member may be adapted to be inserted through the hole of the second identical garment hanger and extend out of a front aperture of the hole of the second identical garment hanger. Upon being inserted through the hole of the second identical garment hanger, the front surface of the cascade hook member may abut a portion of a rear surface of a cascade hanger member of the second identical garment hanger.

A channel may be formed between a portion of the front surface of the cascade hook member and a portion of the rear surface of the cascade hook member of the second identical hanger. Similarly, a cavity may be formed between a portion of the front surface of the cascade hook member and a concavity formed in the rear surface of the cascade hook member of the second identical hanger. Where both a cavity and a channel are formed, the width of the channel may be smaller than the width of the cavity.

In a further embodiment of the invention, a garment hanger is disclosed comprising a hanger body having a front surface, a rear surface, and a hole therethrough, and a hook attached within the hole to the hanger body, wherein the hook is adapted to articulate between a first position extending beyond the front surface and a second position extending beyond the rear surface.

In another embodiment of the invention, a pair of substantially identical nested first and second garment hangers are disclosed wherein each of the first and second garment hangers comprise a hanger body having a front surface, a rear surface, a hole therethrough, and a hook attached within the hole to the hanger body. The hook is adapted to articulate between a first position extending beyond the front surface and a second position extending beyond the rear surface. When the hook of the first hanger is in the first position, the hook extends into the hole of the second hanger and the front surface of the first hanger abuts a rear surface of the second hanger so that the first and second hangers are nested in a common horizontal plane relative to one another.

In yet another embodiment of the invention, a pair of substantially identical nested first and second garment hangers are disclosed wherein each of the first and second garment hangers comprise a hanger body having a front surface, a rear surface, a hole therein, and a hook attached within the hole to the hanger body. The hook is adapted to articulate between a first position extending beyond the front surface and a second position housed within the body. When the hook of the first hanger is in the second position, the front surface of the first hanger abuts a rear surface of the second hanger so that the first and the second hangers are nested in a common horizontal plane relative to one another.

These and other aspects of the subject invention will become more readily apparent to those having ordinary skill in the art from the following detailed description of the invention taken in conjunction with the drawings described herein. Additional objects of the present invention will become apparent from the following description.

The method and apparatus of the present invention will be better understood by reference to the following detailed discussion of specific embodiments and the attached figures which illustrate and exemplify such embodiments.

DESCRIPTION OF THE DRAWINGS

A specific embodiment of the present invention will be described with reference to the following drawings, wherein.

DESCRIPTION OF THE PREFERRED EMBODIMENT

Figure 1:
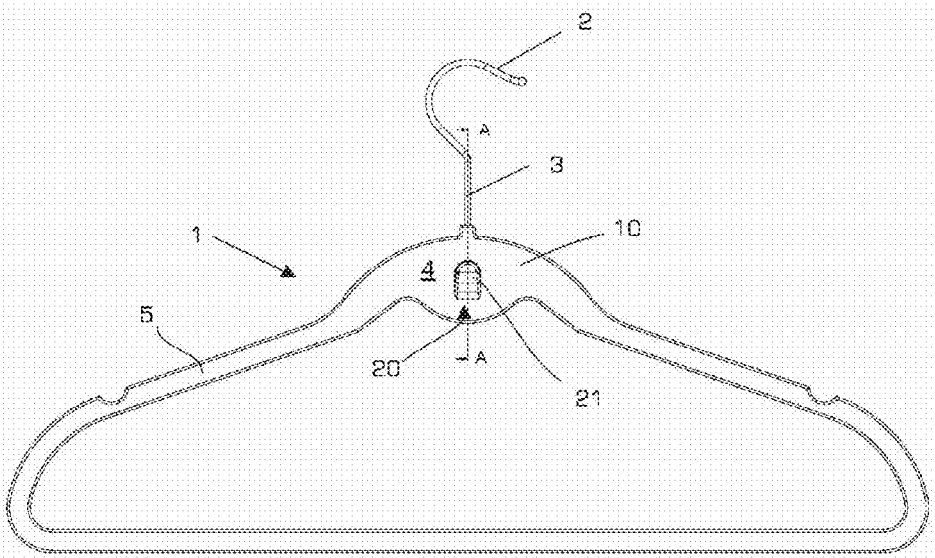
FIG. 1 is a front plan view of a preferred embodiment of the present invention.

The following preferred embodiment as exemplified by the drawings is illustrative of the invention and is not intended to limit the invention as encompassed by the claims of this application. A nestable clothes hanger with an integrated articulating hook is disclosed herein.

Referring generally to the Figures, the hanger generally comprises hanger frame 1 and hook member 2 extending upwardly therefrom. Hanger frame comprises body 4 and arms 5 extending from each side of body 4. Hook member 2 is connected to frame 1 via vertical portion 3.

Hanger body 4 includes a generally planar front surface 10 and a rear surface 11 substantially collateral with front surface 10. Cascade hook 20, which may also be called a "finger", extends from front surface 10.

Figure 2:
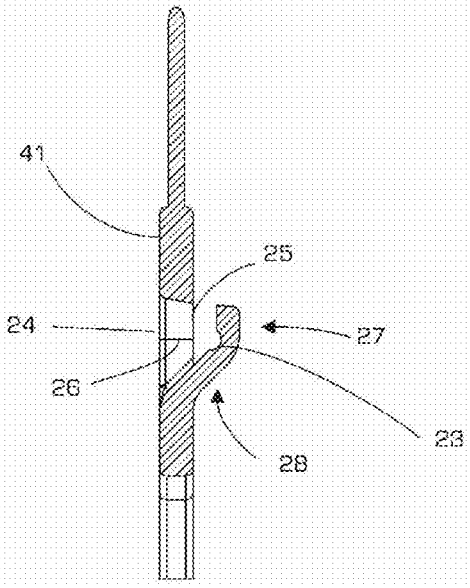
FIG. 2 is a cross-sectional detail of the preferred embodiment depicted in FIG. 1.

Cascade hook 20, shown in FIG. 1 and in cross section in FIG. 2, has a front surface 21 and a rear surface 22, a vertical portion 27 substantially collateral with front surface 10 of hanger body 4 and an inclined portion 28 extending upwardly and outwardly from front surface 10 of hanger body 4. Inclined portion 28 may form an angle of less than 90 degrees from vertical (i.e., less than 90 degrees from the plane of front surface 10). Cascade hook 20 may omit a vertical portion, and inclined portion 28 may be arranged perpendicularly to front surface 10 without departing from the invention disclosed herein, provided that cascade hook 20 may function to support additional hangers therefrom and allows for nesting of hangers, as will be described in greater detail below.

Cascade hook 20 may include a concavity 23, which may be formed at the intersection of the vertical portion 27 and inclined portion 28. Alternatively, concavity 23 may be omitted.

Figures 7, 7A:
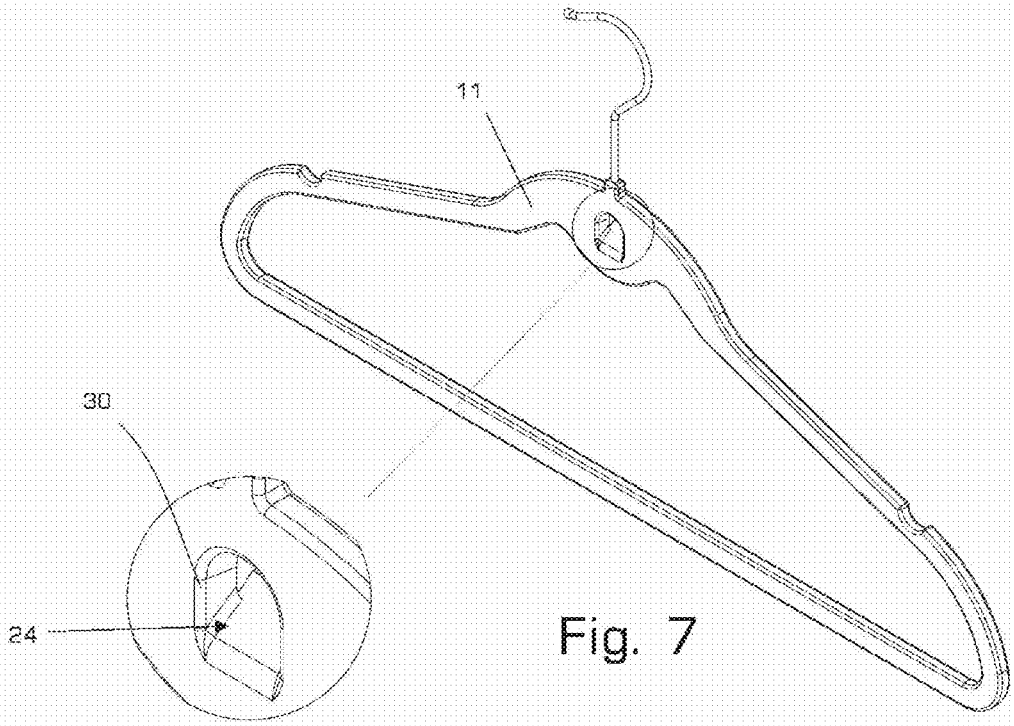
FIG. 7 is a substantially rear orthogonal view of a preferred embodiment of the present invention.
Figure 8:
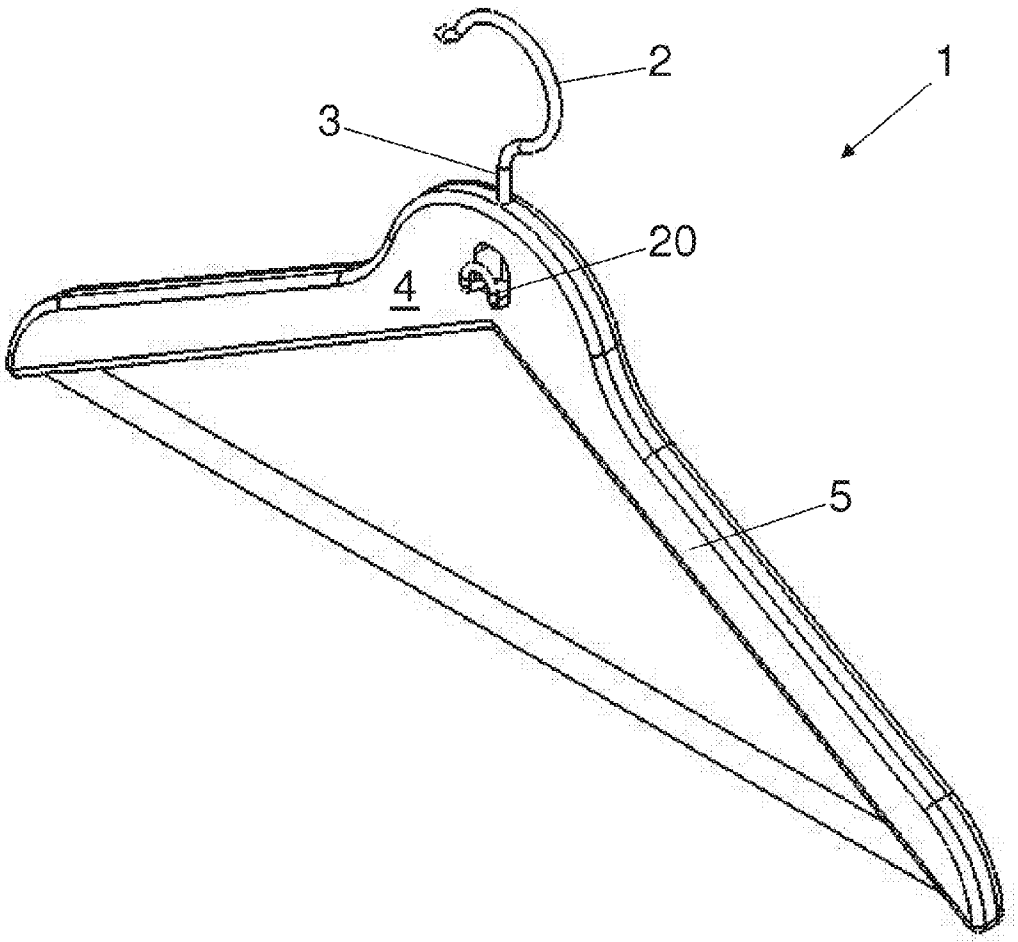
FIG. 8 is an orthogonal view of another embodiment of a hanger of the present invention.

Body 4 includes a hole 26. The hole may either be formed completely through the body, or alternatively, may be only a recess in the body. When the hole is through the body, the hole 26 has a rear aperture 24 formed in the rear surface 11 and a front aperture 25 formed in front surface 10. Rear aperture 24 may include chamfer 30 (depicted more clearly in FIG. 7). Each of the front and rear apertures have a certain area, that is, each has a certain measure of the planar extent it defines.

Cascade hook 20 is shaped substantially the same as front aperture 25, that is, if one projects the shape of cascade hook 20 on the same plane as that occupied by aperture 25 (which is the same as the plane of front surface 10), the projected shape of cascade hook 20 will be substantially the same as the shape of aperture 25. One in the art will readily understand that the projection disclosed herein is not a physical structure, but instead an orthographic projection, that is, a representation of the three dimensional cascade hook 20 on a planar surface corresponding to the plane containing aperture 25.

Front surface 10 may also be curved, in which case apertures 24 and 25 would likewise be curved. In this case, the projection of cascade hook 20 onto a plane would have substantially the same shape as a projection of aperture 25 onto the same plane.

The surface area of front surface 10 which is not occupied by cascade hook 20 may be at least approximately twice that of the surface area occupied by cascade hook 20.

Figure 3:
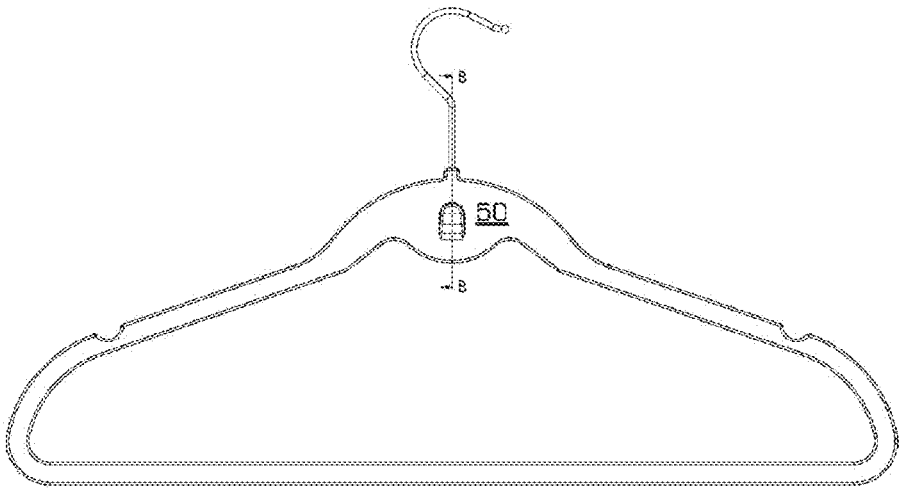
FIG. 3 is a front plan view of two hangers of a preferred embodiment of the present invention shown in a nested configuration.
Figure 4:
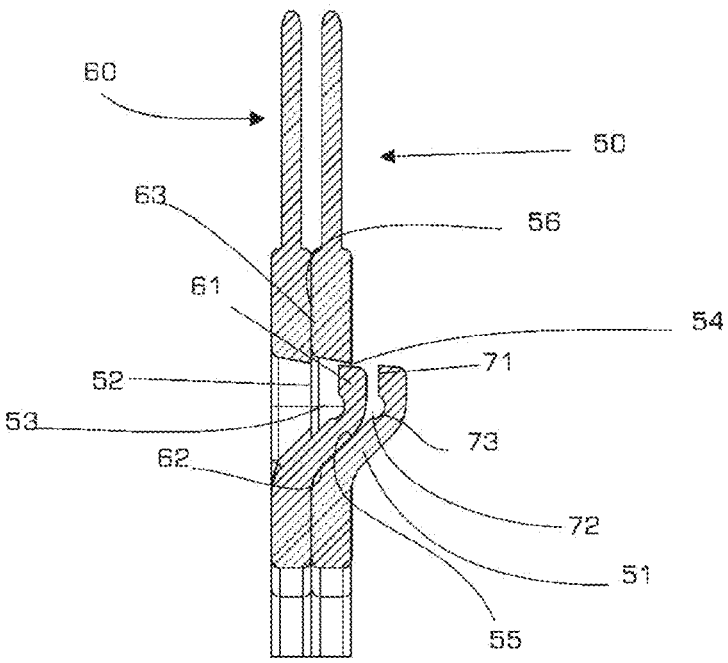
FIG. 4 is a cross-sectional detail of the hangers depicted in FIG. 3.

Referring now to FIGS. 3 and 4, two hangers of one embodiment of the present invention may be seen in a nested configuration. Hanger 50 is placed in front of hanger 60, which is nested with hanger 50. Cascade hook 61 of hanger 60 extends through rear aperture 52 of hanger 50, through hole 53, and partially out front aperture 54 of hanger 50. Front surface 60 of the inclined portion of cascade hook 61 abuts rear surface 55 of cascade hook 51. Front surface 62 of hanger 60 abuts rear surface 56 of hanger 50. Cascade hook 61 may be dimensioned to closely conform to the dimensions of front aperture 54, thereby nesting hanger 60 to hanger 50. Rear aperture 53 may be dimensioned larger than front aperture 54 to more easily receive cascade hook 61 in hole 53.

Figures 5, 5A:
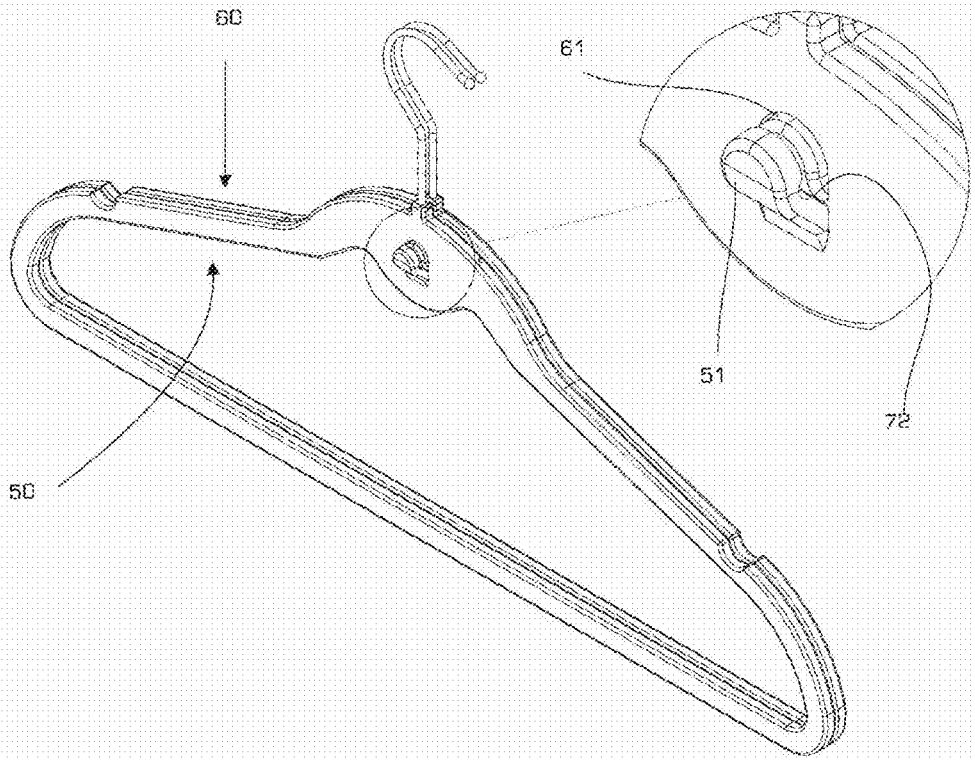
FIG. 5 is an orthogonal view of two hangers of a preferred embodiment of the present invention shown in a nested configuration.
Figures 6, 6A:
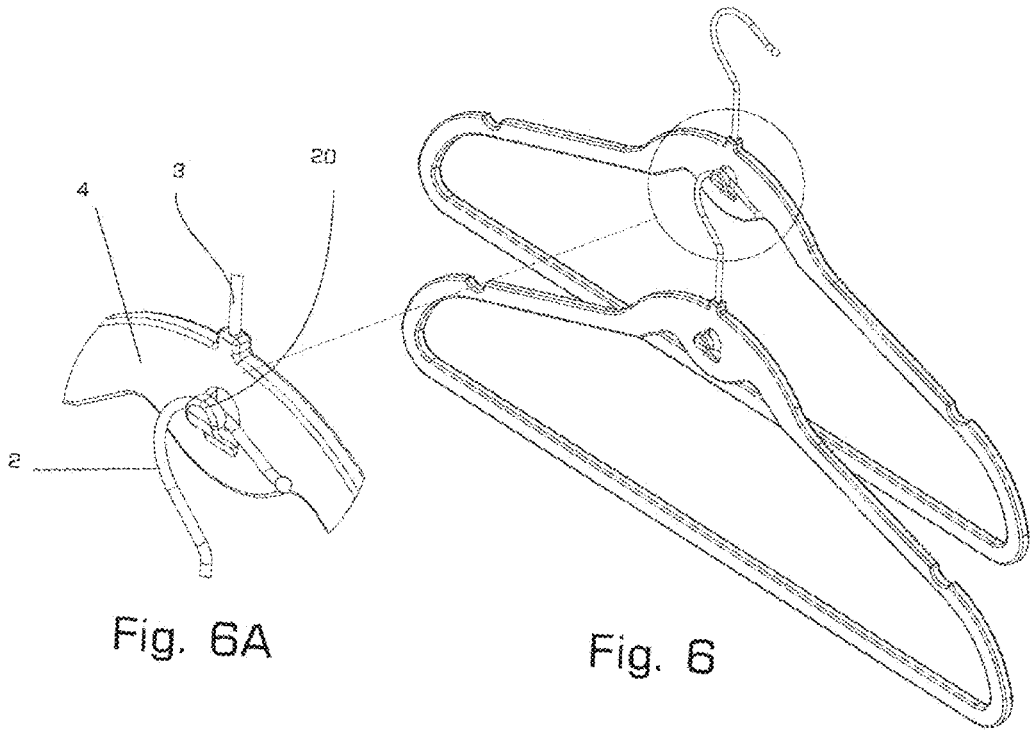
FIG. 6 is an orthogonal view of two hangers of a preferred embodiment of the present invention shown in a cascaded configuration.

When nested as shown in FIGS. 3, 4, and 5, cascade hooks 51 and 61 form channel 71 therebetween, terminating in cavity 72, formed in part by concavity 73 and the front face of cascade hook 61. Concavity 73 may be dimensioned so as to hold a hook member of another hanger therein, while channel 71 may be of smaller dimensions, prohibiting a hook member present in cavity 72 from moving through channel 71, thereby maintaining the hook member in cavity 72. Cavity 72 may be dimensioned to closely approximate the diameter of hook member 2, depicted, for example, in FIGS. 1 and 6.

Figure 9:
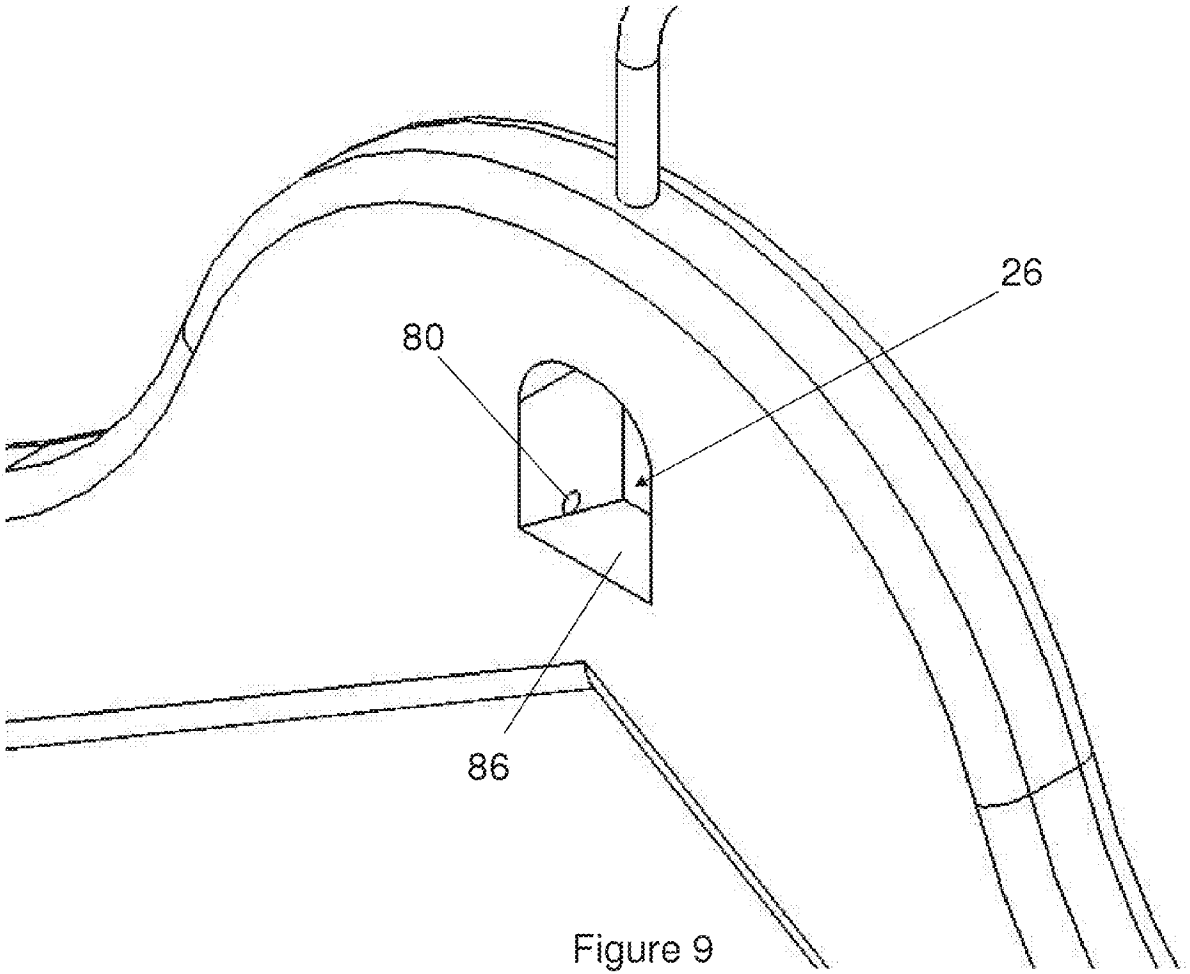
FIG. 9 is an enlarged view of a hole in a body of an embodiment of a hanger of the present invention.
Figure 10:
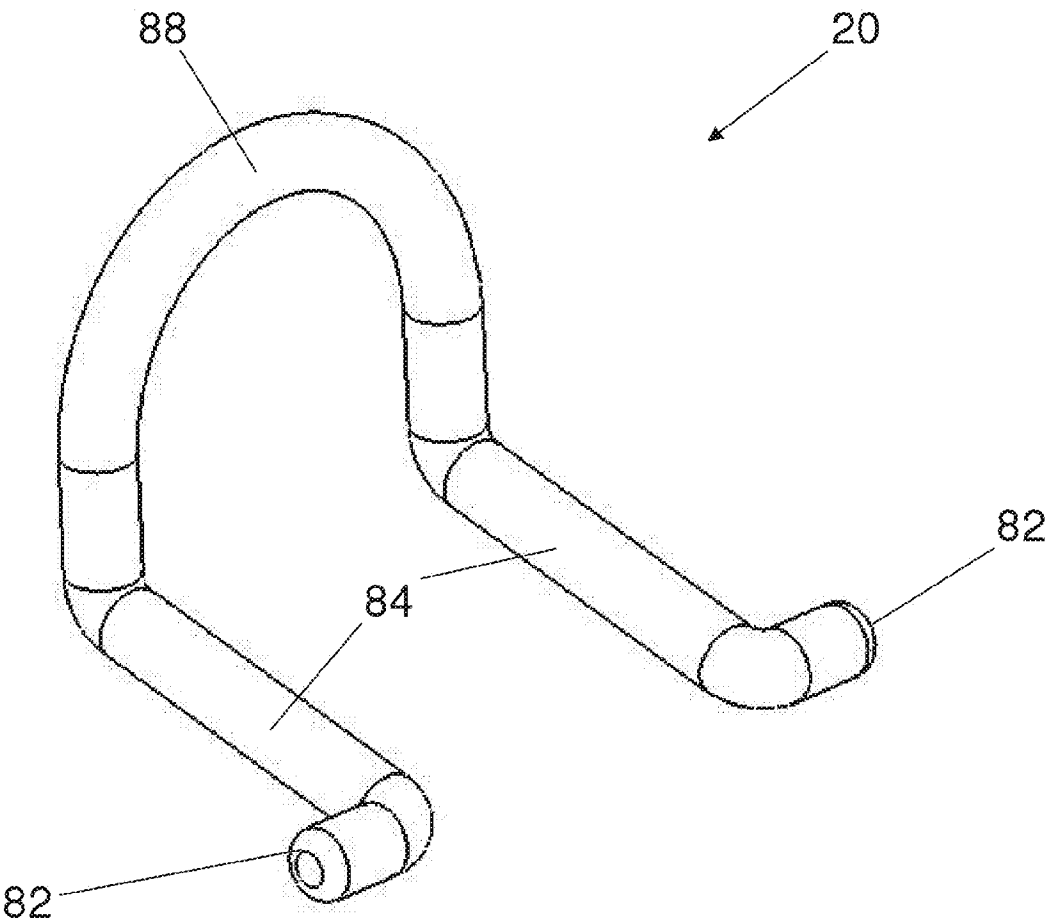
FIG. 10 is an orthogonal view of a hook of an embodiment of a hanger of the present invention.

Another embodiment of the invention is depicted in FIGS. 8-15. As shown specifically in FIGS. 8 and 9, the hook 20 may be attached within the hole 26 of the body. As shown in FIGS. 9 and 10, one manner of attaching the hook within the hole may be by providing a pin hole 80 for receiving a projection 82 of the hook. In this embodiment, the hook may have arms 84 extending from each of the projections adapted for resting upon and being supported by the lower portion 86 of the hole. The arms 84 of the hook are joined to each other by an arch 88 completing the hook of this embodiment.

Figure 11:
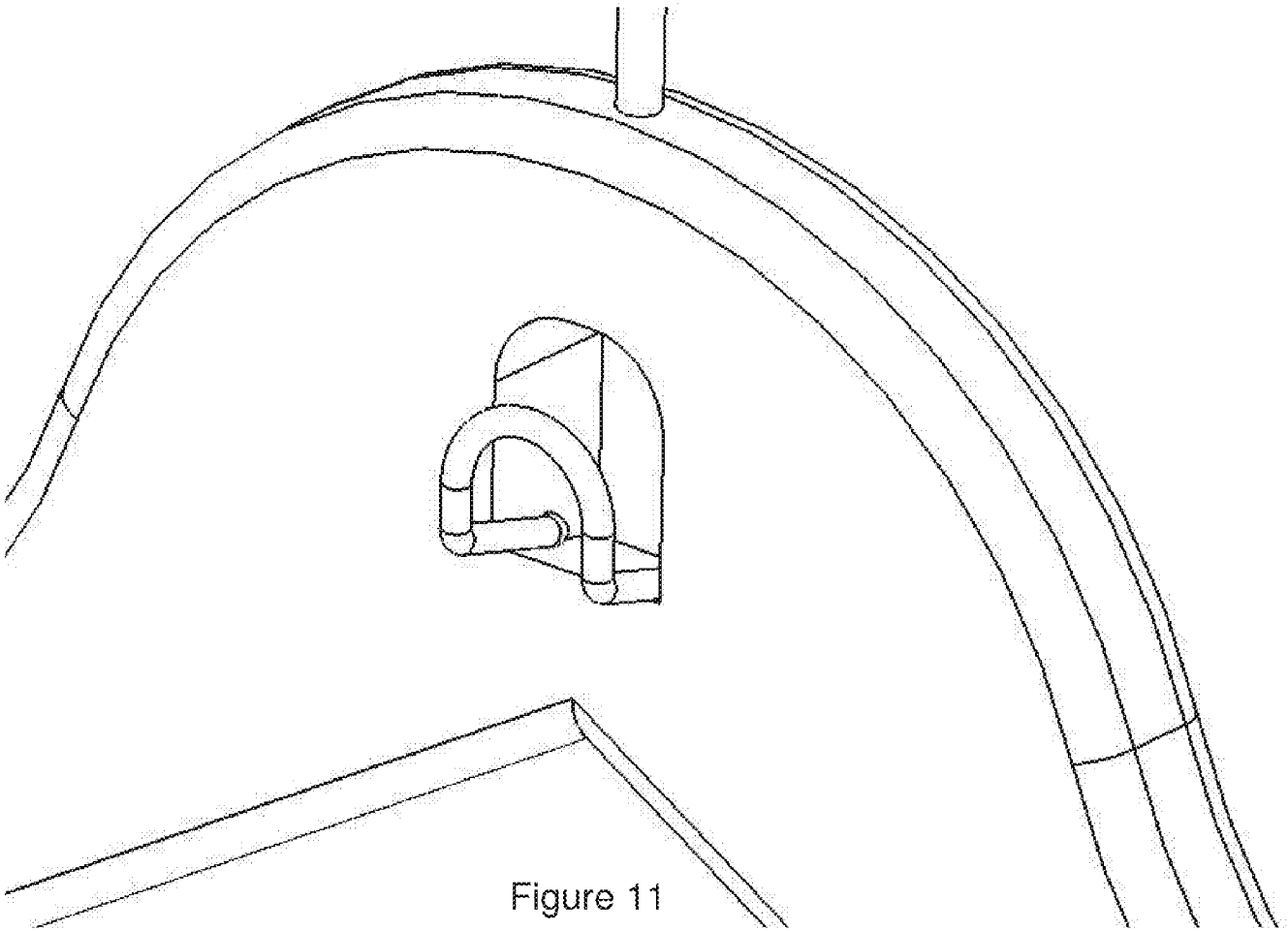
FIG. 11 is an orthogonal view of the hook in the body of FIG. 9.

FIG. 11 depicts an enlarged orthogonal view of the hook extending beyond the front surface of the hanger for another hanger to hang therefrom.

Figure 12:
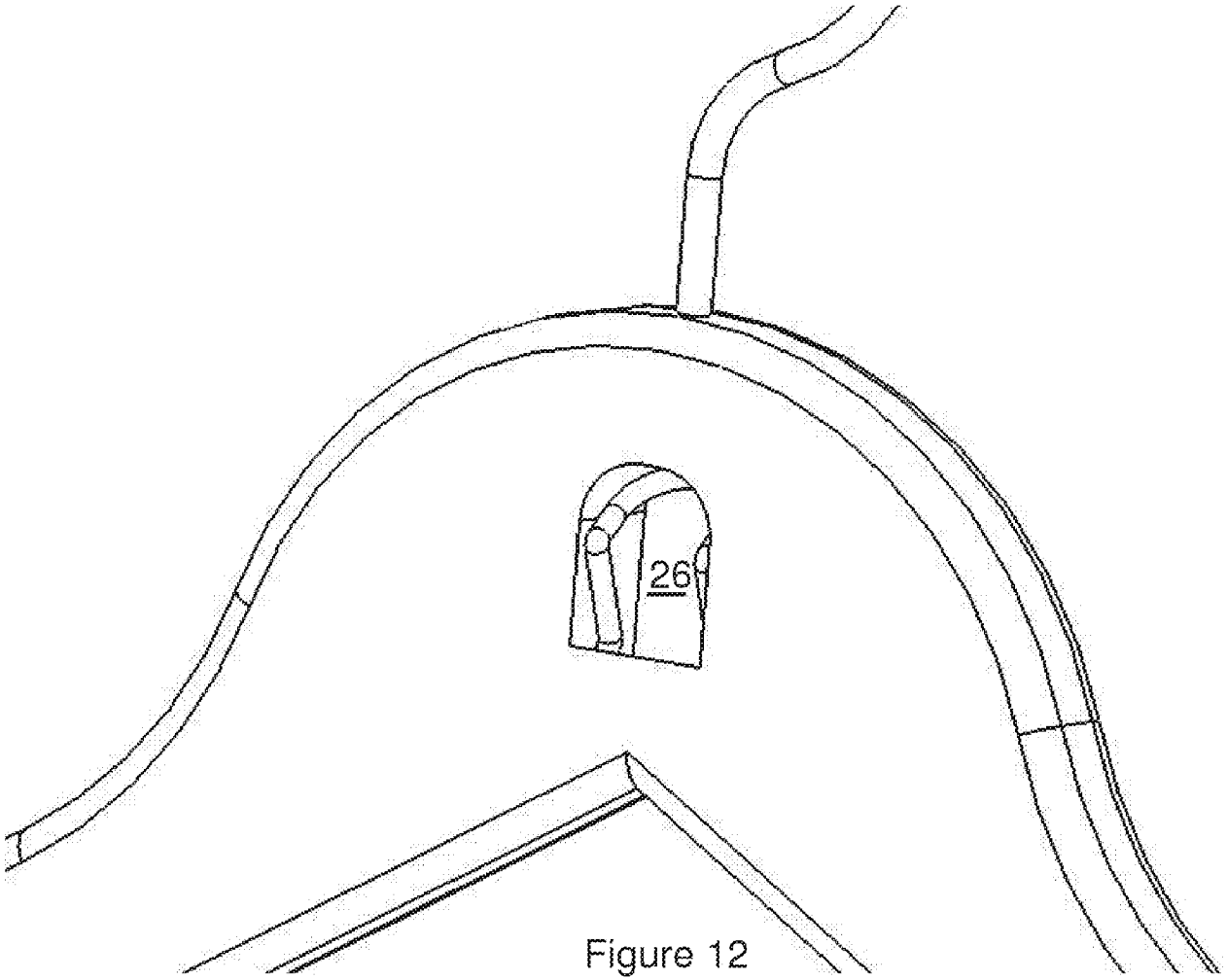
FIG. 12 is an orthogonal view of the hook housed within the body of a hanger of the present invention.
Figure 12A:
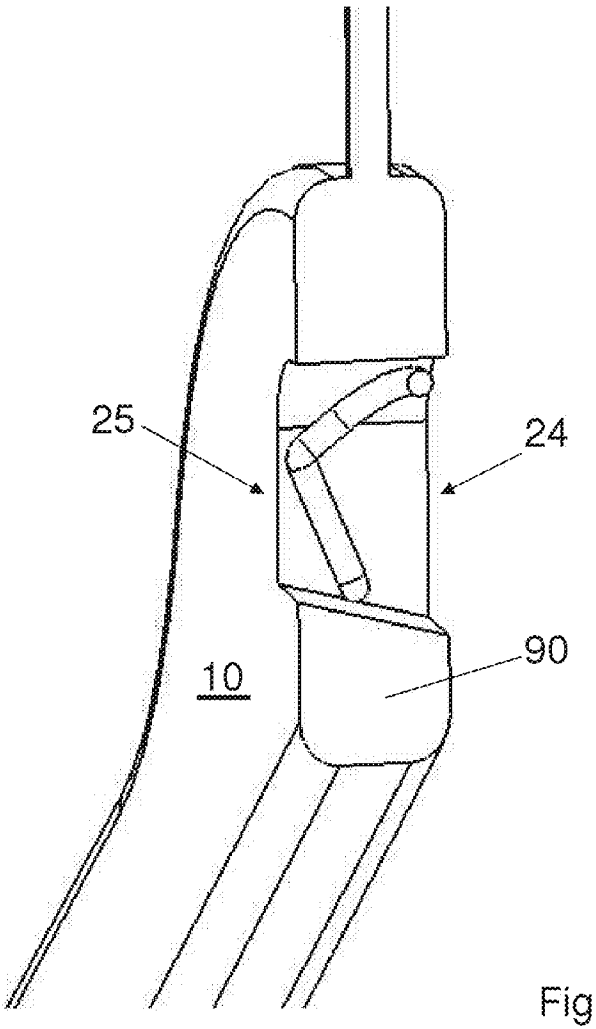
FIG. 12A is a sectional view of FIG. 12.

As further illustrated in FIGS. 12 and 12A, the hook may articulate between a first position extending beyond the front surface of the hanger for another hanger to hang therefrom (FIG. 11) to a second position in which the hook is completely housed within the body of the hanger. The articulation is accomplished by the pivoting of the projections within the pinholes. When the hook is in the position thus depicted, multiple hangers may be stored in a nested fashion for minimizing the storage space they occupy.

As more specifically shown in FIG. 12A, the hanger may be formed by joining two portions along a joint 90. Alternatively, the hanger may be made monolithically with a hole therethrough, as shown in FIG. 13 A.

Figure 13:
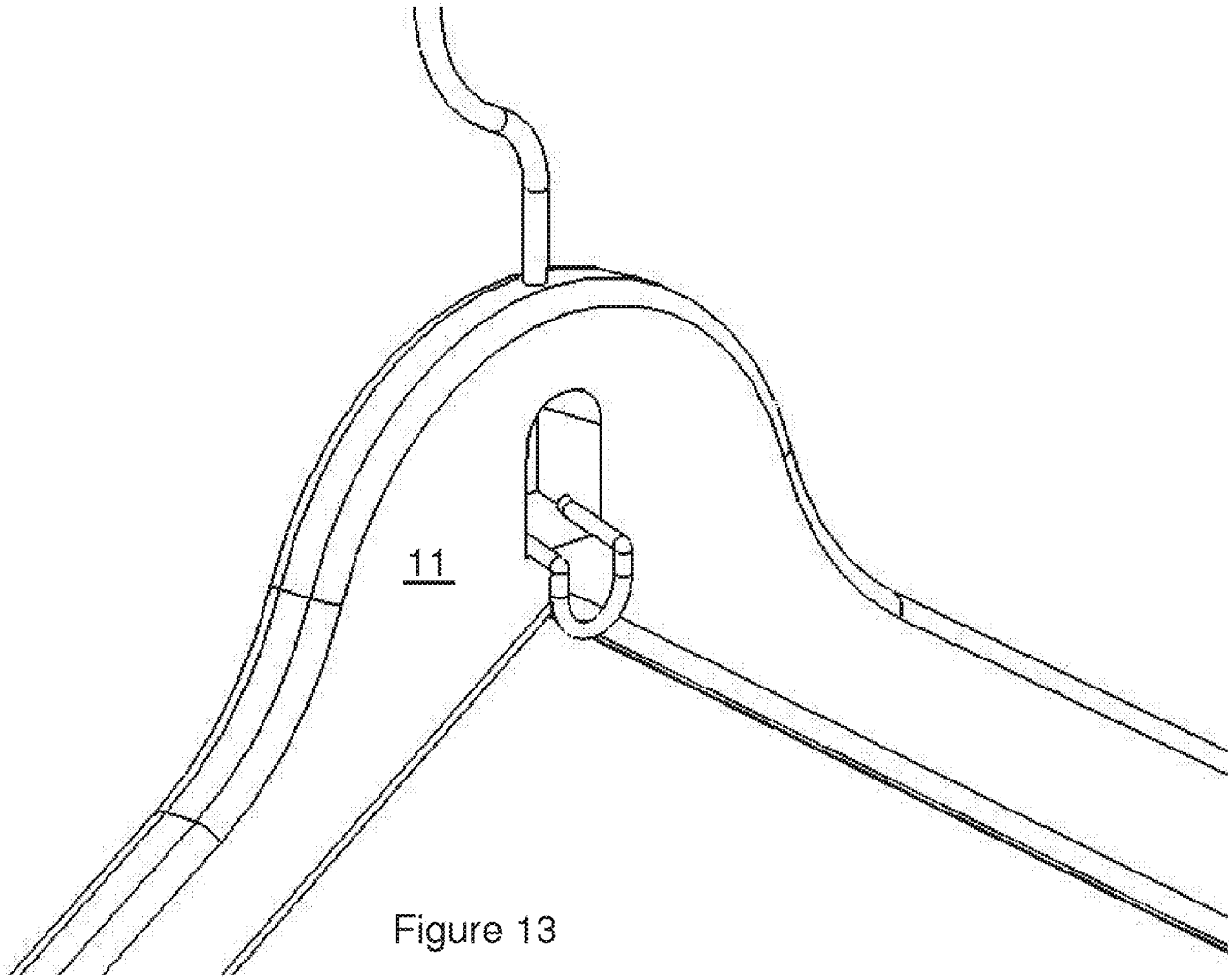
FIG. 13 is an orthogonal view of the hook extending beyond the rear surface of a hanger of the present invention.
Figure 13A:
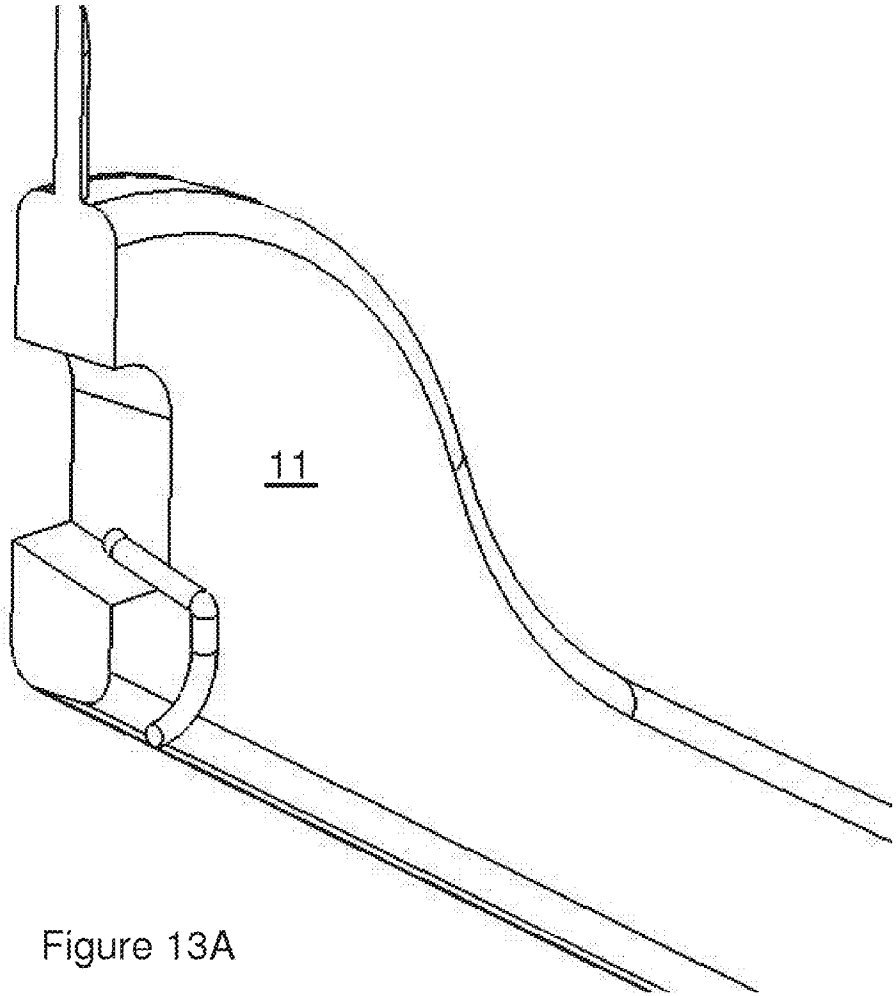
FIG. 13A is a sectional view of FIG. 13.

FIG. 13 shows a further embodiment of the present invention in which the hook may articulate between a first position extending beyond the front surface of the hanger for another hanger to hang therefrom (FIG. 11) to a second position in which the hook extends beyond the rear surface of the hanger. The articulation is accomplished by the pivoting of the projections within the pinholes. Another hanger may be hung from the hook when it extends beyond the rear surface of the hanger. In this embodiment, an intermediate position is provided in which the hook may be housed within the body for storing multiple hangers in a nested fashion thereby minimizing the storage space they occupy.

Figure 14:
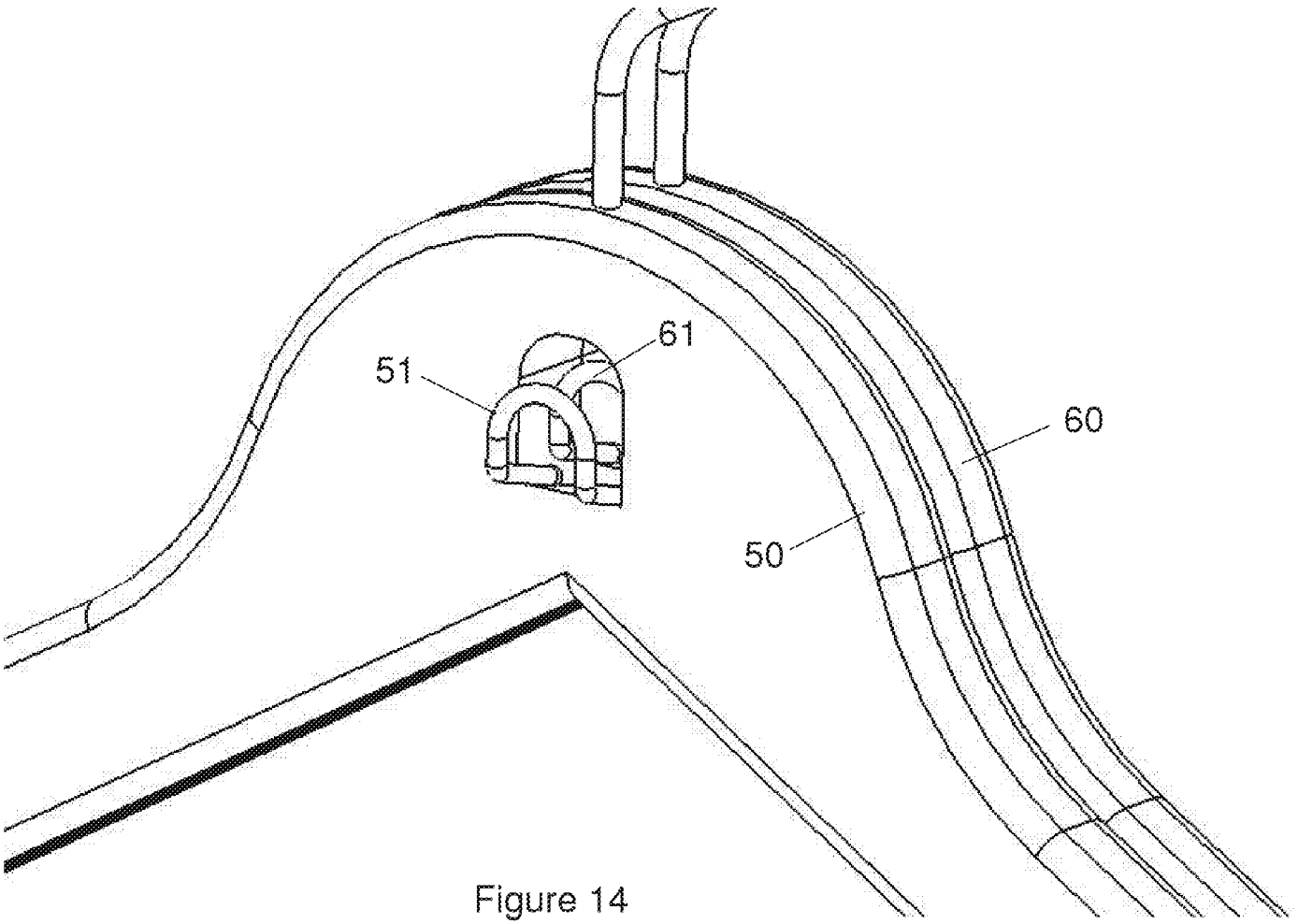
FIG. 14 is an orthogonal view of a pair of nested hangers of FIG. 8.
Figure 14A:
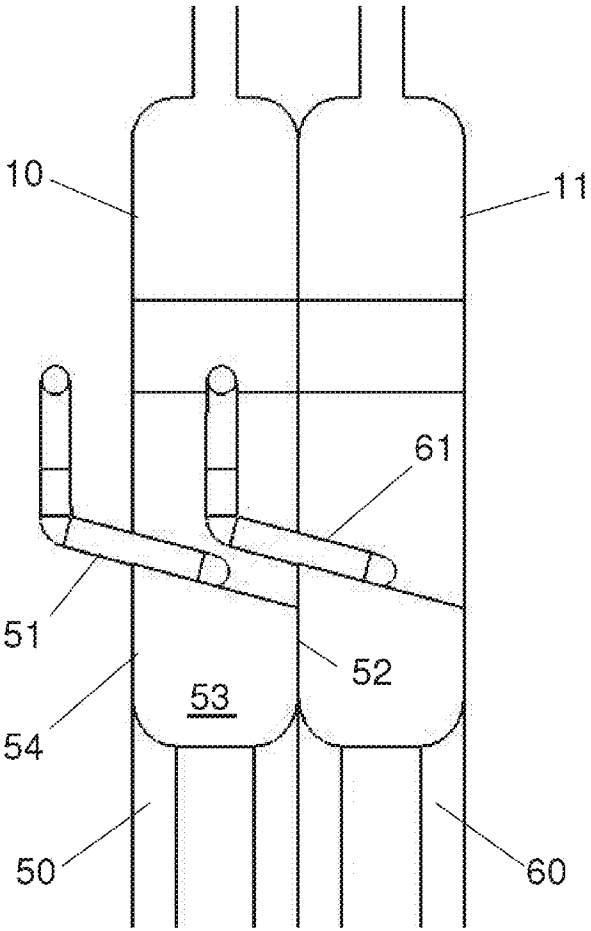
FIG. 14A is a sectional view of FIG. 14.
Figure 15:
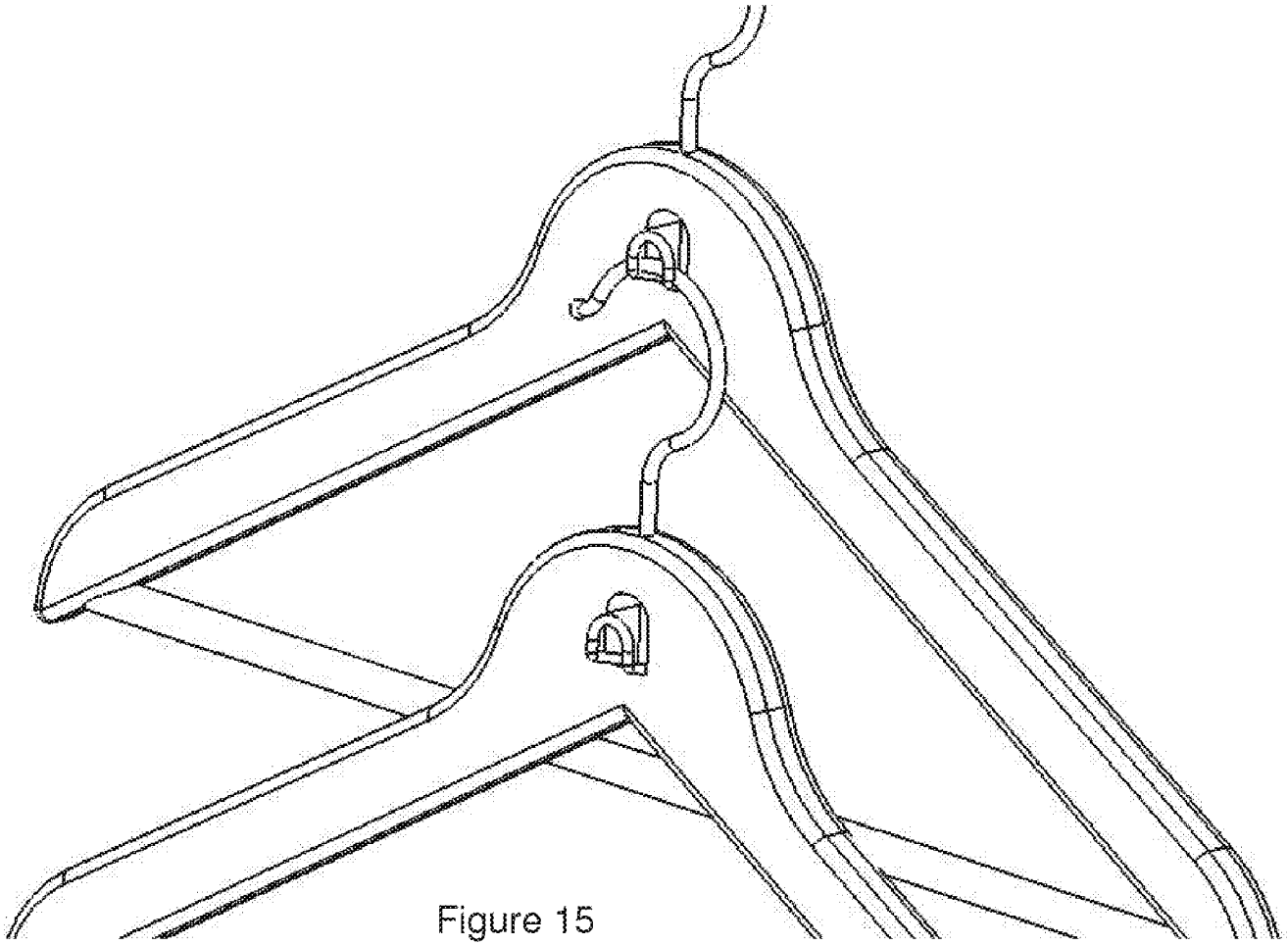
FIG. 15 is an orthogonal view of a pair of hangers of FIG. 8 showing one hanger hanging from another.

FIGS. 14 and 14A illustrate an alternative way to nesting the hangers from that of positioning the hooks within the body. In this embodiment, the hangers may be nested with the hook in a position extending beyond the front surface of the hanger. As shown therein, the hook extending beyond the front surface of a first hanger extends into the hole of a second hanger positioned in front of the front surface of the first hanger. The front surface of the first hanger abuts a rear surface of the second hanger so that the first and the second hangers are nested in a common horizontal plane relative to one another.

Figure 16:
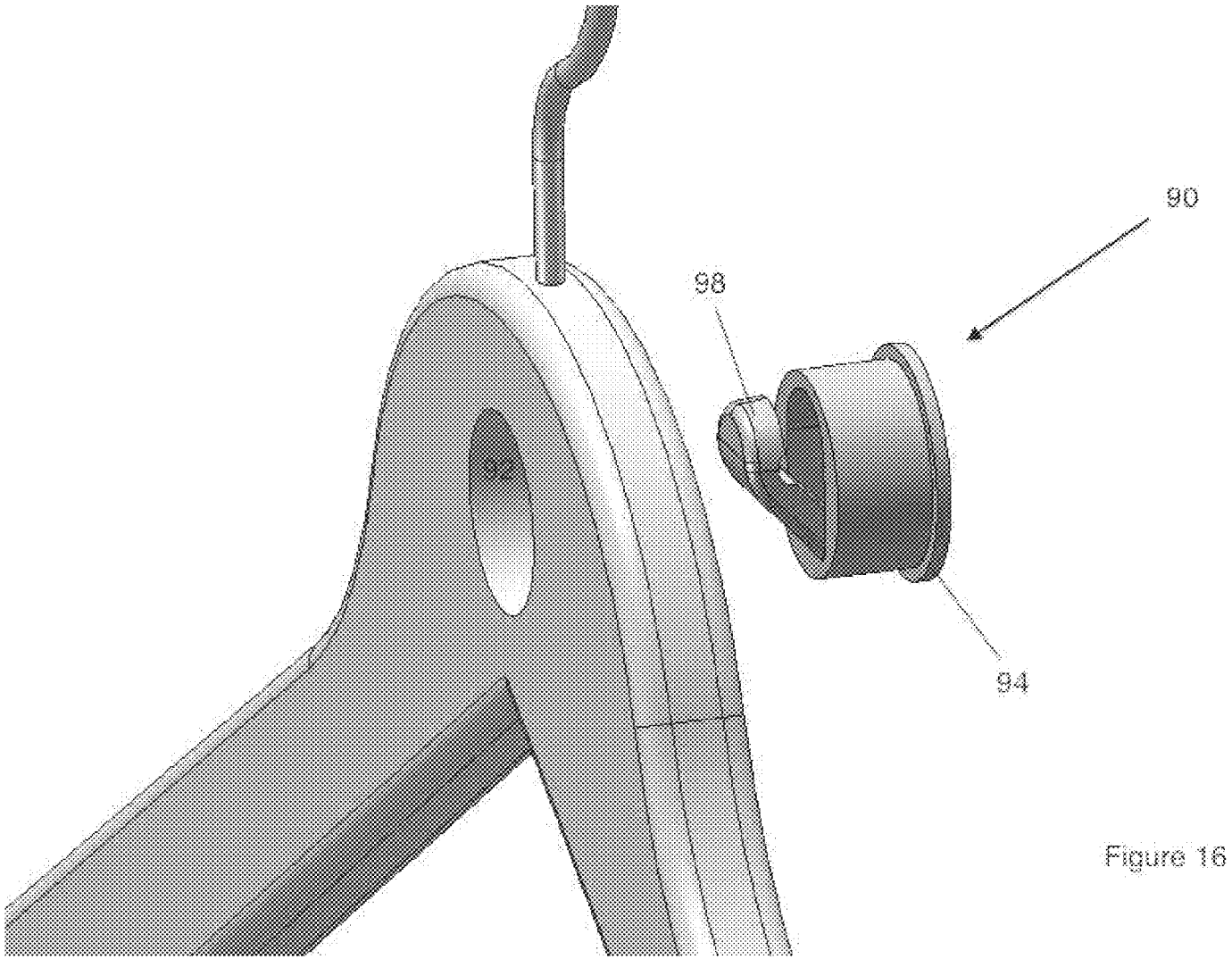
FIG. 16 is a front orthogonal view of a hook insert for another embodiment of a hanger of the present invention.

Still another embodiment of the present invention is depicted in FIGS. 16-19. FIG. 16 is a front orthogonal view of a hook insert 90 for another embodiment of a hanger of the present invention. The hook insert 90 may be made of any material, for example, either metal or plastic.

The hook insert is configured to be inserted into a hole 92 in the hanger. The shape of the hole may be of any shape, be it polygonal, elliptical, or circular. In the particular embodiment depicted, the hole 92 in the hanger is circular thereby matching the circular configuration of the hook insert 90. The hook insert 90 has a flange 94 on one side. The flange 94 is circumferential in shape, matching the shape of the hook insert itself. The circumferential flange 94 is configured to fit snugly within a corresponding recess 96 in the hanger which is slightly larger than the hole itself.

Figure 17:
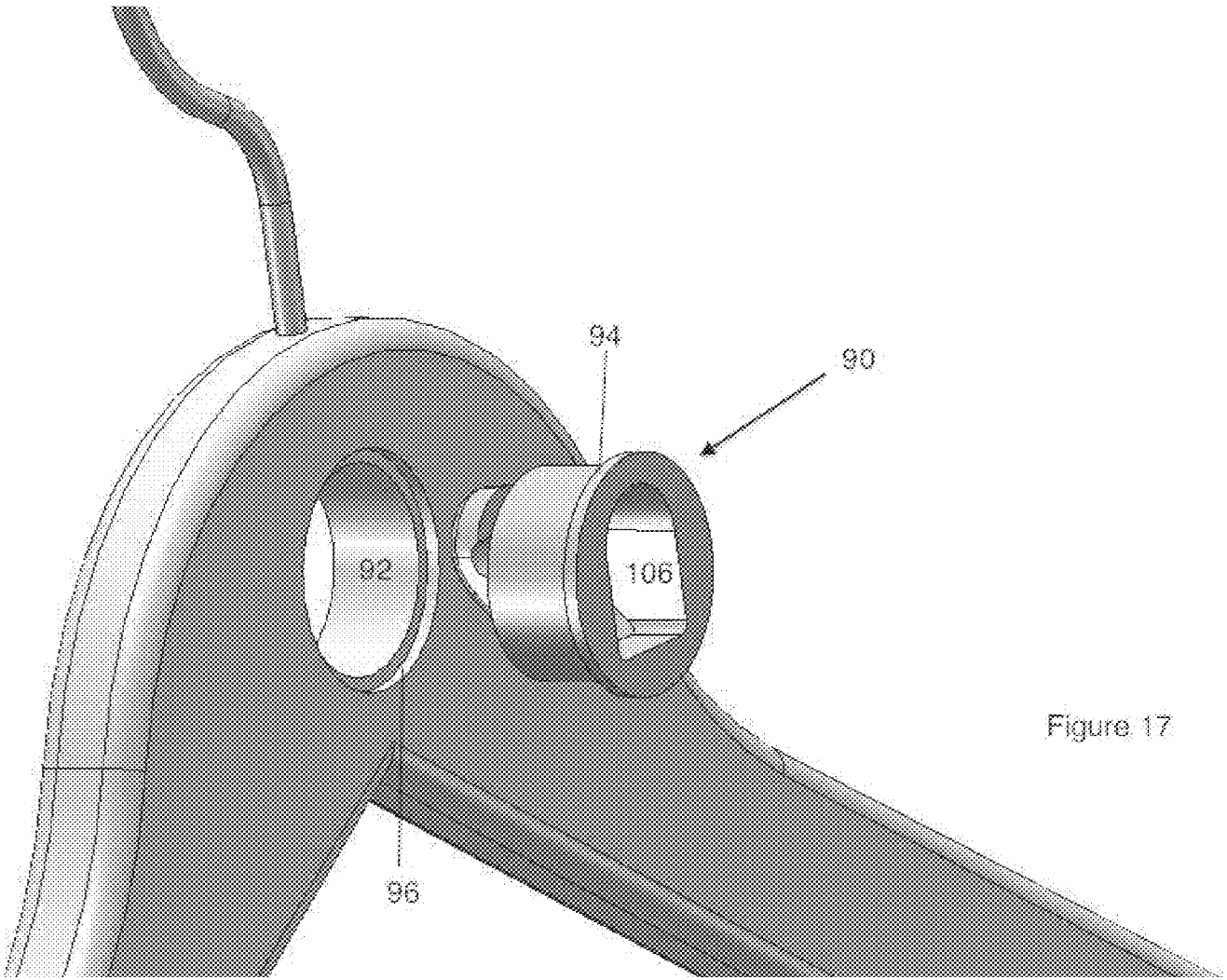
FIG. 17 is a rear orthogonal view of a hook insert for the embodiment of a hanger of FIG. 16.

FIG. 17 is a rear orthogonal view of the hook insert and more particularly illustrates the flange 94 and its corresponding recess 96 in the hanger.

Figure 18:
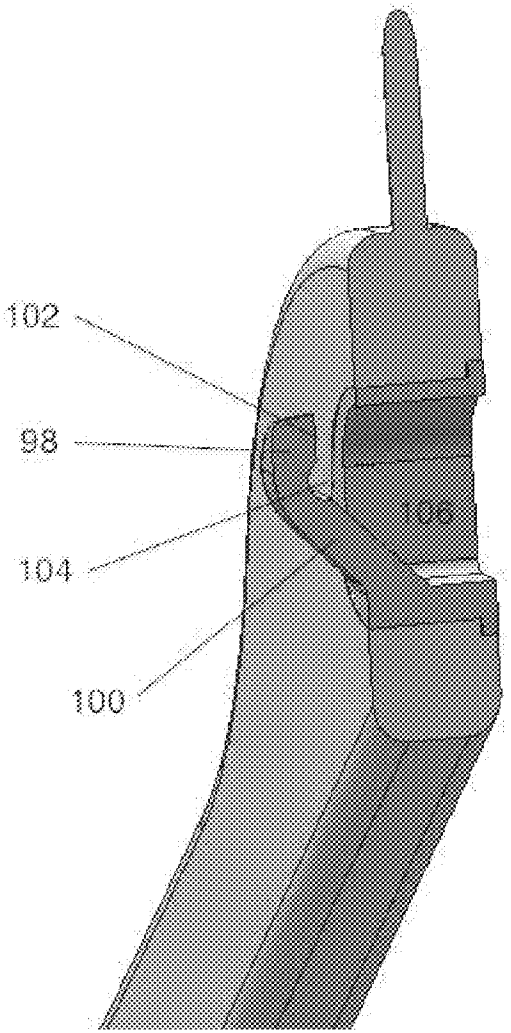
FIG. 18 is a sectional view of FIG. 16.

FIG. 18 is a sectional view of FIG. 16 showing the hook insert set in the hanger. In this view, the form fitting hole of the hanger is shown as well as the setting of the flange in the recess. On the side of the hook insert opposite that of the flange is a hook 98 that has a similar profile to the hooks previously described in the present application. As shown, the hook 98 is attached at its base to the hook insert and curves upwardly and outwardly therefrom by an inclined portion 100. The hook may form an angle of less than 90 degrees from vertical (i.e., less than 90 degrees from the plane of the front of the hanger) and typically has an arcuate top portion.

The hook 98 may include a vertical portion 102 and a concavity 104, which may be formed at the intersection of the vertical portion 102 and the inclined portion 100. Alternatively, the concavity 104 may be omitted.

Further shown in both FIGS. 17 and 18 is insert cavity 106. Insert cavity 106 may be dimensioned to closely approximate the size of the hook 98. In this manner, one hanger having an insert therein may be nested with another hanger having an insert therein.

Figure 19:
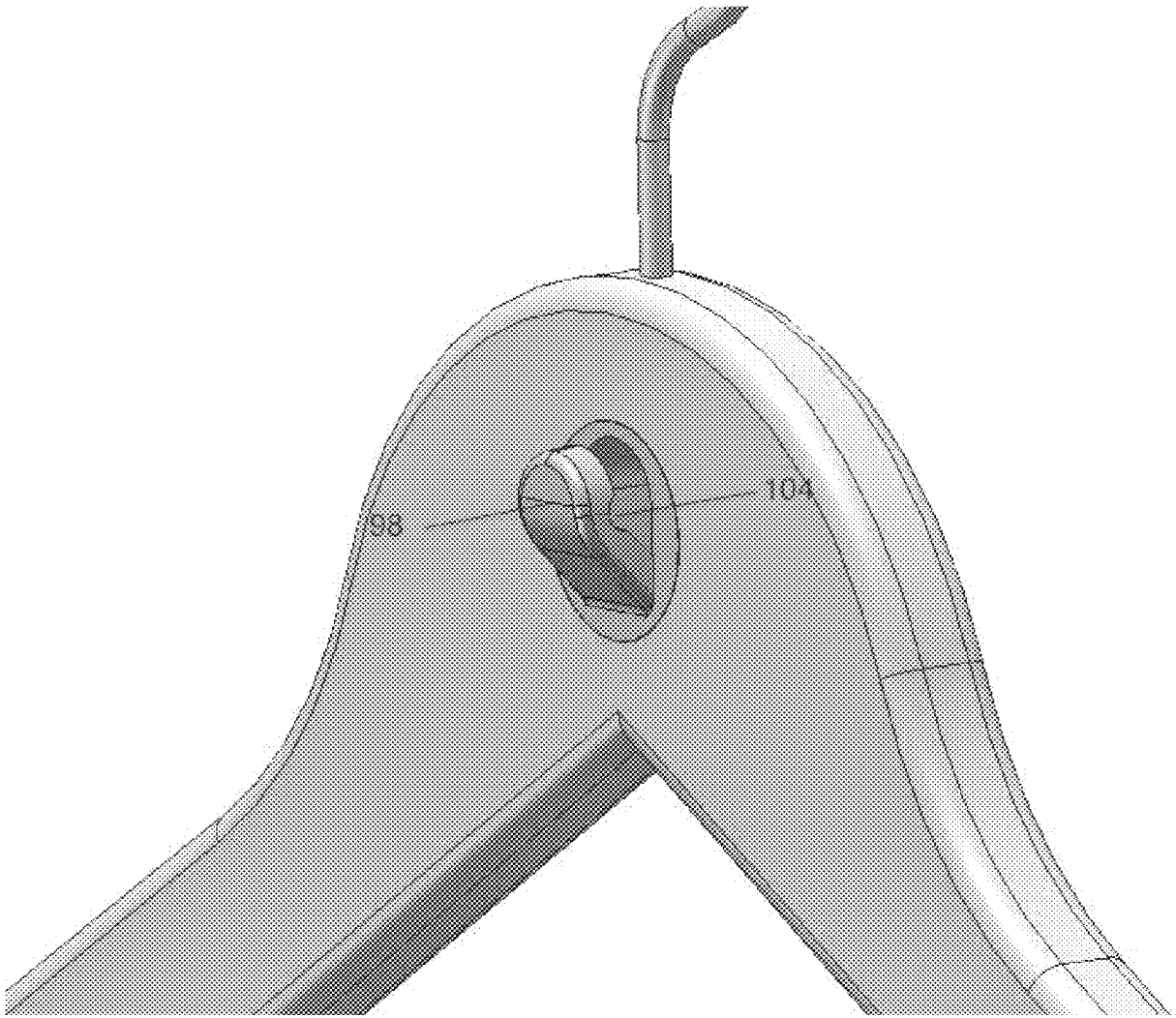
FIG. 19 is an orthogonal view of the hook insert set in the embodiment of a hanger of FIG. 16.

FIG. 19 is an orthogonal front view of the hook insert set in the embodiment of a hanger of FIG. 16.

Although the particular embodiments shown and described above will prove to be useful in many applications in the clothing storage art to which the present invention pertains, further modifications of the present invention will occur to persons skilled in the art. All such modifications are deemed to be within the scope and spirit of the present invention as defined by the appended claims.

What is claimed is:

1. An insert for a garment hanger, comprising a body having back and a front, a hook extending from the front, a flange, and a hole formed in and extending from the back, wherein the hole is sized to receive a hook from a corresponding insert when the front of the corresponding insert is positioned against the back of the insert.

2. The insert of claim 1, wherein the hook has an inclined portion, a vertical portion, and a concavity therebetween.

3. The insert of claim 2, wherein the inclined portion is at an angle of less than 90 degrees from the vertical.

4. The insert of claim 3, wherein the hook has an arcuate top portion.

5. The insert of claim 1 wherein the hole is completely bounded by the insert.

6. The insert of claim 1 wherein the hole is substantially perpendicular to the back of the insert.

7. A garment hanger, comprising:

a. a hanger body having a front surface, a rear surface, and a hole therethrough; and b. an insert attached within the hole to the hanger body, wherein said insert has a back and a front, a hook extending from the front, a flange, and a hole formed in and extending from the back, wherein the hole in the insert is sized to receive a hook from a corresponding insert when the front of the corresponding insert is positioned against the back of the insert.

8. The garment hanger of claim 7, wherein the hook has an inclined portion, a verticalportion, and a concavity therebetween.

9. The garment hanger of claim 8, wherein the inclined portion is at an angle of less than 90 degrees from the vertical.

10. The garment hanger of claim 9, wherein the hook has an arcuate top portion.

11. The insert of claim 7 wherein the insert hole is substantially perpendicular to the rear surface of the garment hanger.

12. A pair of substantially identical nested first and second garment hangers, each said first and second garment hanger comprising:

a. a hanger body having a front surface, a rear surface, and a hole therethrough; and b. an insert attached within the hole to the hanger body, wherein said insert has a back and a front, a hook extending from the front, a flange, and a hole formed in and extending from the back, wherein the hole in the insert is sized to receive another hook from a corresponding insert when the front of the corresponding insert is positioned against the back of the insert.

13. The pair of substantially identical nested first and second garment hangers of Claim 12, wherein the hooks have an inclined portion, a vertical portion, and a concavity therebetween.

14. The pair of substantially identical nested first and second garment hangers of Claim 13, wherein the inclined portions are at an angle of less than 90 degrees from the vertical.

15. The pair of substantially identical nested first and second garment hangers of Claim 14, wherein the hook has an arcuate top portion.

16. The insert of claim 12 wherein the insert hole is substantially perpendicular to the rear surface of the garment hanger.

* * * * *